US006752654B1

(12) United States Patent
Huang et al.

(10) Patent No.: US 6,752,654 B1
(45) Date of Patent: Jun. 22, 2004

(54) SERIAL ADVANCED TECHNOLOGY ATTACHMENT CONNECTOR

(75) Inventors: Ching-Bin Huang, Taipei (TW); Chih-Chuan Cheng, Taipei (TW); Wei-Pin Chuang, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 10/411,255

(22) Filed: Apr. 11, 2003

(51) Int. Cl.[7] ..... H01R 13/60

(52) U.S. Cl. ..... 439/541.5; 439/108; 439/79

(58) Field of Search ..... 439/541.5, 79, 439/607, 108, 660

(56) References Cited

U.S. PATENT DOCUMENTS

| | | | | | |
|---|---|---|---|---|---|
| 5,525,067 | A | * | 6/1996 | Gatti | 439/108 |
| 6,065,979 | A | * | 5/2000 | Lai et al. | 439/79 |
| 6,109,968 | A | * | 8/2000 | Wang | 439/607 |
| 6,162,068 | A | * | 12/2000 | Wu | 439/79 |
| 6,171,116 | B1 | * | 1/2001 | Wicks et al. | 439/79 |

* cited by examiner

*Primary Examiner*—Hien Vu
(74) *Attorney, Agent, or Firm*—Bacon & Thomas, PLLC

(57) ABSTRACT

A SATA connector includes a housing, signal and power panels disposed in the housing and aligned in a vertical direction, signal terminals mounted on the signal panel, and first and second power terminals respectively mounted on two opposite surfaces of the power panel. Each signal terminal is aligned with a respective first power terminal and a respective second power terminal in the vertical direction.

5 Claims, 3 Drawing Sheets

SERIAL ADVANCED TECHNOLOGY ATTACHMENT CONNECTOR

BACKGROUND OF THE INVENTION

1. Field of the Invention

This invention relates to a serial advanced technology attachment (SATA) connector, more particularly to a serial advanced technology attachment connector that can be installed on a housing of a notebook computer for connecting an external hard drive to a mother board of the notebook computer.

2. Description of the Related Art

FIG. 1 illustrates a conventional serial advanced technology attachment (SATA) connector 1 that is installed on a mother board in a housing of a notebook computer (not shown) for electrically connecting an internal hard drive, such as a hard disc drive or a CD (compact disc) drive, through an assembly of a signal plug 12 and a power plug 14. The conventional SATA connector 1 includes a signal sub-connector 11 for mating with the signal plug 12, and a power sub-connector 13 for mating with the power plug 14. Since the hard disc drive in the housing of the notebook computer rotates at a very high speed during data transmission, a relatively large amount of heat is generated in the housing of the notebook computer, which can result in an increase in the temperature of the notebook computer, and which can have an adverse effect on the performance of the notebook computer. Moreover, since terminals on the signal sub-connector 11 and terminals on the power sub-connector 13 are aligned in a longitudinal direction, the conventional SATA connector 1 has a relatively long length in the longitudinal direction.

SUMMARY OF THE INVENTION

Therefore, the object of the present invention is to provide a SATA connector that is adapted to be installed on the housing of a notebook computer instead of being installed on the mother board as required by the prior art so as to permit electrical connection of the mother board to an external hard drive and that is relatively compact so as to reduce the length thereof as compared to that of the conventional SATA connector.

According to the present invention, there is provided a serial advanced technology attachment connector that comprises: an insulating housing defining a mounting space therein and having a bottom wall that defines a horizontal plane, and a front open end for access into the mounting space; an insulating signal panel disposed in the mounting space, parallel to the horizontal plane, and having a surface that is parallel to the horizontal plane; an insulating power panel disposed in the mounting space and parallel to and aligned with the signal panel in a vertical direction that is perpendicular to the horizontal plane, the power panel having opposite first and second surfaces that are parallel to the horizontal plane; a plurality of signal terminals, each of which has a contact extension and a leg, the contact extensions of the signal terminals being laid on the surface of the signal panel, being parallel to each other, extending in a first direction, and being aligned in a second direction that is transverse to the first direction, the leg extending from the contact extension in the vertical direction through the bottom wall; a plurality of first power terminals, each of which has a contact extension and a leg, the contact extensions of the first power terminals being laid on the first surface of the power panel, being parallel to each other, extending in the first direction, and being aligned in the second direction, the leg of each of the first power terminals extending from the contact extension of the first power terminal in the vertical direction through the bottom wall; and a plurality of second power terminals, each of which has a contact extension and a leg. The contact extensions of the second power terminals are laid on the second surface of the power panel, are parallel to each other, extend in the first direction, and are aligned in the second direction. The leg of each of the second power terminals extends from the contact extension of the second power terminal in the vertical direction through the bottom wall.

BRIEF DESCRIPTION OF THE DRAWINGS

In drawings which illustrate an embodiment of the invention.

DETAILED DESCRIPTION OF THE PREFERRED EMBODIMENT

Figure 1:
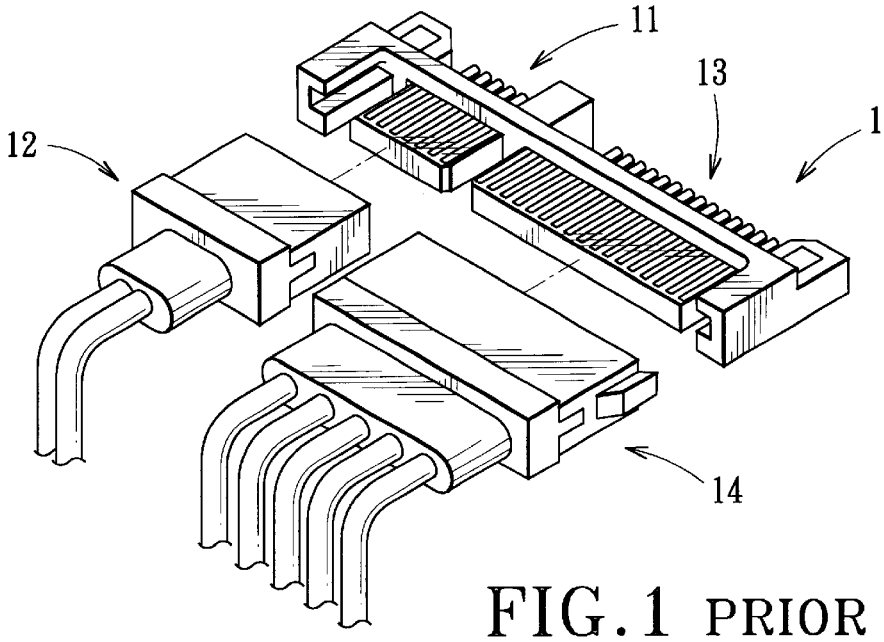
FIG.1 PRIOR ART
FIG. 1 is a perspective view of a conventional serial advanced technology attachment (SATA) connector, which can be electrically connected to a hard drive through an assembly of a power plug and a signal plug.
Figure 2:
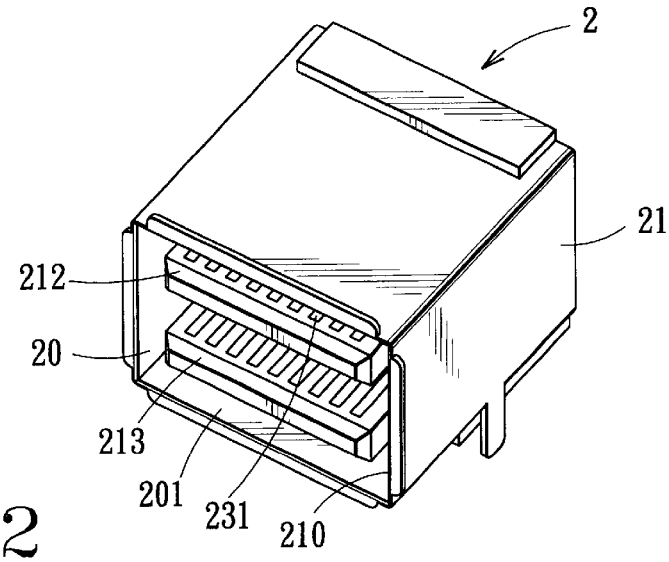
FIG. 2 is a perspective view of a SATA connector embodying this invention.
Figure 3:
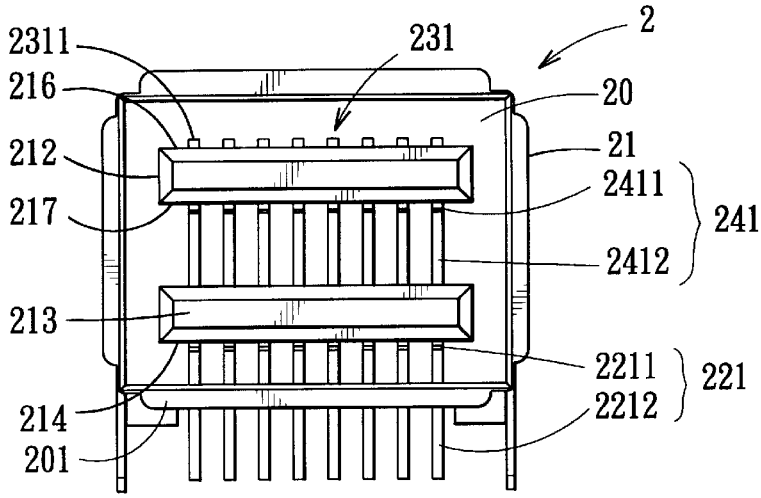
FIG. 3 is a front view of the SATA connector of FIG. 2.
Figure 4:
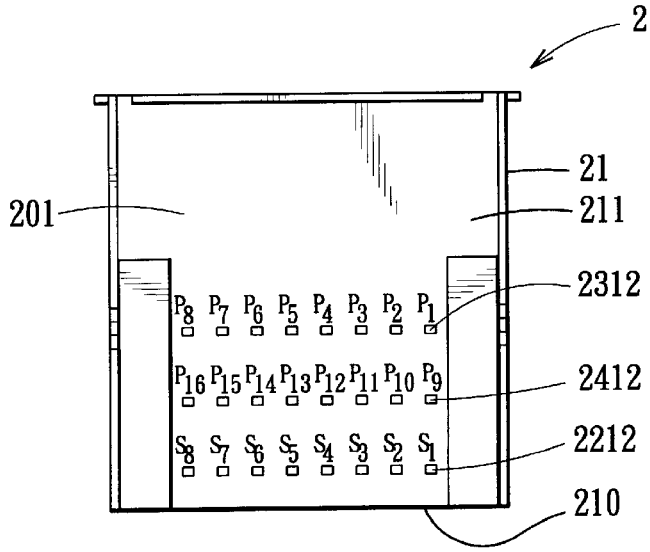
FIG. 4 is a fragmentary bottom view of the SATA connector of FIG. 2.

FIGS. 2 to 4 illustrate a serial advanced technology attachment (SATA) connector 2 embodying this invention. The SATA connector 2 is to be installed on a housing of a notebook computer (not shown) instead of being installed on a mother board of the notebook computer as required by the prior art so as to permit electrical connection of the mother board to an external hard drive (not shown).

The SATA connector 2 includes: an insulating housing 21 defining a mounting space 20 therein and having a bottom wall 201 that defines a horizontal plane, and a front open end 210 for access into the mounting space 20; an insulating signal panel 213 disposed in the mounting space 20, parallel to the horizontal plane, and having a bottom surface 214 that is parallel to the horizontal plane; an insulating power panel 212 disposed in the mounting space 20 and parallel to and aligned with the signal panel 213 in a vertical direction that is perpendicular to the horizontal plane, the power panel 212 having opposite first and second surfaces 216, 217 that are parallel to the horizontal plane; a plurality of signal terminals 221, each of which has a contact extension 2211 and a leg 2212, the contact extensions 2211 of the signal terminals 221 being laid on the bottom surface 214 of the signal panel 213, being parallel to each other, extending in a first direction, and being aligned in a second direction that is transverse to the first direction, the leg 2212 extending from the contact extension 2211 in the vertical direction through the bottom wall 201; a plurality of first power terminals 231, each of which has a contact extension 2311 and a leg 2312, the contact extensions 2311 of the first power terminals 231 being laid on the first surface 216 of the power panel 212, being parallel to each other, extending in the first direction, and being aligned in the second direction, the leg 2312 of each of the first power terminals 231 extending from the contact extension 2311 of the first power terminal 231 in the vertical direction through the bottom wall 201; and a plurality of second power terminals 241, each of which has a contact extension 2411 and a leg 2412. The contact extensions 2411 of the second power terminals 241 are laid on the second surface 217 of the power panel 212, are parallel to each other, extend in the first direction, and are aligned in the second direction. The leg 2412 of each of the second power terminals 241 extends from the contact extension 2411 of the second power terminal 241 in the vertical direction through the bottom wall 201. The signal panel 213 is disposed between the bottom wall 201 of the housing 21 and the power panel 212. The bottom surface 214 of the signal panel 213 confronts the bottom wall 201 of the housing 21. The legs 2212, 2312, 2412 of the signal terminals 221 and the first and second power terminals 231, 241 are secured to the bottom wall 2021 so as to suspend the power and signal panels 212, 213 in the housing 21, and are adapted to be electrically connected to the mother board (not shown).

In this preferred embodiment, the signal terminals 221, the first power terminals 231, and the second power terminals 241 are equal in number (each group has eight terminals). The contact extension 2211 of each of the signal terminals 221 is aligned with the contact extension 2311 of a respective one of the first power terminals 231 and the contact extension 2411 of a respective one of the second power terminals 241 in the vertical direction. The leg 2212 of each of the signal terminals 221 is aligned with the leg 2312 of the respective one of the first power terminals 231 and the leg 2412 of the respective one of the second power terminals 241 in the first direction. The thus formed SATA connector 2 is relatively compact, and has a reduced length in the second direction as compared to that of the conventional SATA connector.

The signal terminals 221 include a first ground terminal (S1), a pair of first differential signal terminals (S2, S3), a second ground terminal (S4), a third ground terminal (S5), a pair of second differential signal terminals (S6, S7), and a fourth ground terminal (S8), which are arranged in the second direction in the above order.

The first power terminals 231 include a first 3-volt power terminal (P1), a second 3-volt power terminal (P2), a third 3-volt power terminal (P3), a first ground terminal (P4), a second ground terminal (P5), a third ground terminal (P6), a first 12-volt power terminal (P7), and a second 12-volt power terminal (P8), which are arranged in the second direction in the above order.

The second power terminals 241 include a first 5-volt power terminal (P9), a second 5-volt power terminal (P10), a third 5-volt power terminal (P11) a fourth ground terminal (P12), a fifth ground terminal (P13), a sixth ground terminal (P14), a reserved terminal (P15), and a third 12-volt power terminal (P16), which are arranged in the second direction in the above order.

Figure 5:
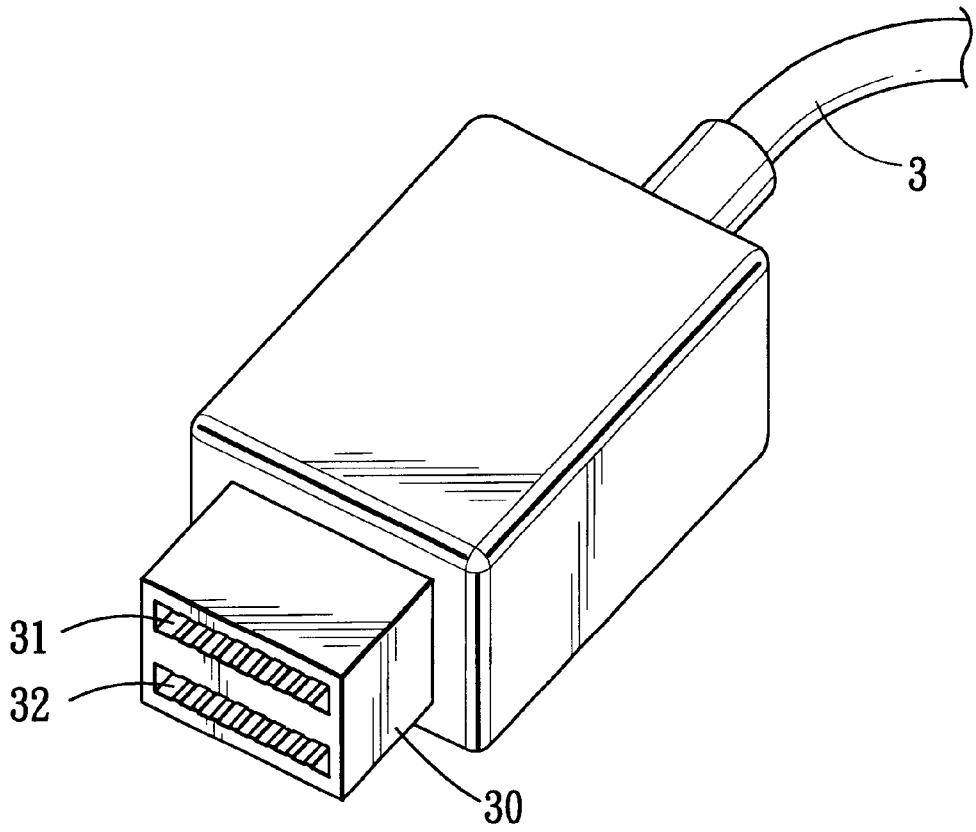
FIG. 5 is a perspective view of a plug for electrically connecting the SATA connector of FIG. 2 to a hard drive.

FIG. 5 illustrates a cable 3 with a plug 30 that is adapted to be electrically connected to the external hard drive and that is formed with first and second terminal-receiving slots 31, 32 which respectively receive the power panel 212 and the signal panel 213 therein when the plug 30 is inserted into the mounting space 20 in the housing 21 of the SATA connector 2.

With the invention thus explained, it is apparent that various modifications and variations can be made without departing from the spirit of the present invention. It is therefore intended that the invention be limited only as recited in the appended claims.

We claim:

1. A serial advanced technology attachment connector comprising:

an insulating housing defining a mounting space therein and having a bottom wall that defines a horizontal plane, and a front open end for access into said mounting space;

an insulating signal panel disposed in said mounting space, parallel to said horizontal plane, and having a surface that is parallel to said horizontal plane;

an insulating power panel disposed in said mounting space and parallel to and aligned with said signal panel in a vertical direction that is perpendicular to said horizontal plane, said power panel having opposite first and second surfaces that are parallel to said horizontal plane;

a plurality of signal terminals, each of which has a contact extension and a leg, said contact extensions of said signal terminals being laid on said surface of said signal panel, being parallel to each other, extending in a first direction, and being aligned in a second direction that is transverse to said first direction, said leg extending from said contact extension in said vertical direction through said bottom wall;

a plurality of first power terminals, each of which has a contact extension and a leg, said contact extensions of said first power terminals being laid on said first surface of said power panel, being parallel to each other, extending in said first direction, and being aligned in said second direction, said leg of each of said first power terminals extending from said contact extension of said first power terminal in said vertical direction through said bottom wall; and a plurality of second power terminals, each of which has a contact extension and a leg, said contact extensions of said second power terminals being laid on said second surface of said power panel, being parallel to each other, extending in said first direction, and being aligned in said second direction, said leg of each of said second power terminals extending from said contact extension of said second power terminal in said vertical direction through said bottom wall, wherein said signal terminals include a first ground terminal, a pair of first differential signal terminals, a second ground terminal, a third ground terminal, a pair of second differential signal terminals, and a fourth ground terminal.

2. The connector of claim 1, wherein said signal terminals, said first power terminals, and said second power terminals are equal in number, said contact extension of each of said signal terminals being aligned with said contact extension of a respective one of said first power terminals and said contact extension of a respective one of said second power terminals in said vertical direction, said leg of each of said signal terminals being aligned with said leg of the respective one of said first power terminals and said leg of the respective one of said second power terminals in said first direction.

3. The connector of claim 1, wherein said signal panel is disposed between said bottom wall and said power panel, said surface of said signal panel confronting said bottom wall.

4. The connector of claim 1, wherein said first power terminals include a first 3-volt power terminal, a second 3-volt power terminal, a third 3-volt power terminal, a first ground terminal, a second ground terminal, a third ground terminal, a first 12-volt power terminal, and a second 12-volt power terminal.

5. The connector of claim 4, wherein said second power terminals include a first 5-volt power terminal, a second 5-volt power terminal, a third 5-volt power terminal, a fourth ground terminal, a fifth ground terminal, a sixth ground terminal, a reserved terminal, and a third 12-volt power terminal.

* * * * *